US010202873B2

(12) United States Patent
Kim et al.

(10) Patent No.: US 10,202,873 B2
(45) Date of Patent: Feb. 12, 2019

(54) SUPERCRITICAL $CO_2$ GENERATION SYSTEM APPLYING PLURAL HEAT SOURCES

(71) Applicant: Doosan Heavy Industries & Construction Co., Ltd., Gyeongsangnam-do (KR)

(72) Inventors: Hak Soo Kim, Gyeonggi-do (KR); Song Hun Cha, Gyeonggi-do (KR); Sang Hyeun Kim, Gyeonggi-do (KR); Jun Tae Jang, Seoul (KR)

(73) Assignee: Doosan Heavy Industries & Construction Co., Ltd., Changwon-si, Gyeongsangnam-do (KR)

( * ) Notice: Subject to any disclaimer, the term of this patent is extended or adjusted under 35 U.S.C. 154(b) by 68 days.

(21) Appl. No.: 15/431,045

(22) Filed: Feb. 13, 2017

(65) Prior Publication Data

US 2017/0234169 A1 Aug. 17, 2017

(30) Foreign Application Priority Data

Feb. 11, 2016 (KR) ..... 10-2016-0015477

(51) Int. Cl.

| | |
|---|---|
| ***F01K 25/10*** | (2006.01) |
| ***F01K 7/16*** | (2006.01) |
| ***F01K 11/02*** | (2006.01) |

(52) U.S. Cl.

CPC ..... *F01K 25/103* (2013.01); *F01K 7/16* (2013.01); *F01K 11/02* (2013.01)

(58) Field of Classification Search

CPC . F01K 7/16; F01K 7/32; F01K 23/064; F01K 23/10; F01K 25/103

See application file for complete search history.

(56) References Cited

U.S. PATENT DOCUMENTS

| | | | |
|---|---|---|---|
| 2006/0112692 | A1 | 6/2006 | Sundel |
| 2014/0208750 | A1 | 7/2014 | Vermeersch et al. |
| 2015/0076831 | A1 | 3/2015 | Giegel |

FOREIGN PATENT DOCUMENTS

| | | | |
|---|---|---|---|
| JP | H06-042703 | A | 2/1994 |
| JP | 2012145092 | A | 8/2012 |
| KR | 10-2014-0064704 | A | 5/2014 |

OTHER PUBLICATIONS

International Search Report in International Application No. PCT/KR2017/001242, filed Feb. 5, 2017.

*Primary Examiner* — Jonathan Matthias

(74) *Attorney, Agent, or Firm* — Saliwanchik, Lloyd & Eisenschenk

(57) ABSTRACT

The present invention relates to a supercritical $CO_2$ generation system applying plural heat sources. According to the present invention, each heat exchanger is effectively disposed according to conditions such as an inlet and outlet temperature, capacity, the number, etc. of the heat source, such that it is possible to use the same or smaller number of recuperators as compared to the number of heat sources, thereby simplifying the system configuration and implementing effective operation.

20 Claims, 2 Drawing Sheets

SUPERCRITICAL $CO_2$ GENERATION SYSTEM APPLYING PLURAL HEAT SOURCES

CROSS-REFERENCE TO RELATED APPLICATION

This application claims priority to Korean Patent Application No. 10-2016-0015477, filed Feb. 11, 2016, the disclosure of which is incorporated herein by reference in its entirety.

BACKGROUND OF THE INVENTION

Field of the Invention

Exemplary embodiments of the present invention relate to a supercritical $CO_2$ generation system applying plural heat sources, more particularly, to a supercritical $CO_2$ generation system applying plural heat sources capable of efficiently disposing and operating a heat exchanger according to a condition of the heat sources.

Description of the Related Art

As the need to efficiently produce power is gradually increased, and a move to decrease emission of pollutants has become active globally, various efforts for increasing power production while decreasing emission of pollutants have been made. As one of such efforts, research and development of a power generation system using supercritical $CO_2$ as a working fluid as disclosed in Japanese Patent Laid-Open Publication No. 2012-145092 has been actively conducted.

Supercritical $CO_2$ has a similar density to a liquid state and similar viscosity to gas, thus it is possible to implement miniaturization of a device and significantly decrease power consumption required for compression and circulation of a fluid. At the same time, the supercritical $CO_2$ has a critical point at 31.4° C. and 72.8 atm, which is much lower than that of water having a critical point at 373.95° C. and 217.7 atm, thus may be easily handled. The supercritical $CO_2$ generation system shows pure power generation efficiency of about 45% when being operated at 550° C. The supercritical $CO_2$ generation system may improve generation efficiency by 20% or more as compared to that of the existing steam cycle, and may reduce a size of a turbo device.

When plural constrained heat sources are applied as a heat source, since a system configuration is complicated and it is difficult to effectively use heat, most of the supercritical $CO_2$ generation systems generally have one heater as a heat source. Therefore, the system configuration is restrictive, and it is difficult to effectively use the heat source.

BRIEF SUMMARY

The present invention provides a supercritical $CO_2$ generation system applying plural heat sources capable of efficiently disposing and operating a heat exchanger according to a condition of the heat source.

Other aspects of the present invention can be understood by the following description, and become apparent with reference to the embodiments of the present invention. Also, it is obvious to those skilled in the art to which the present invention pertains that the benefits of the present invention can be realized by the means as claimed and combinations thereof.

In accordance with one aspect of the present invention, a supercritical $CO_2$ generation system applying plural heat sources includes: a pump circulating a working fluid; a plurality of heat exchangers heating the working fluid through external heat sources; a plurality of turbines operated by the working fluid heated by passing through the heat exchangers; and a plurality of recuperators cooling the working fluid passing through the turbines by heat exchange between the working fluid passing through the turbines and the working fluid passing through the pump, in which the heat exchangers are heat sources using heat of waste heat gas exhausted from a waste heat source and include a plurality of constrained heat exchangers having an emission regulation condition of a discharge end, and an integrated flow rate ($mt_0$) of the working fluid is supplied to the recuperators.

The emission regulation condition may be a temperature condition.

The number of recuperators may be the same as or less than the number of heat exchangers.

The turbines may include a low pressure turbine operating the pump and a high pressure turbine operating a generator, and the integrated flow rate ($mt_0$) of the working fluid passing through the low pressure turbine and the high pressure turbine may be branched and supplied to the plurality of recuperators.

The supercritical $CO_2$ generation system applying plural heat sources may further include a three-way valve installed at a branch point of a transfer pipe through which the working fluid is transferred, so that the working fluid is branched.

The recuperators may include a first recuperator, a second recuperator, and a third recuperator, some of the integrated flow rate ($mt_0$) of the working fluid may be branched to the first recuperator, and the rest of the integrated flow rate of the working fluid may be branched to the second and third recuperators.

The third recuperator may be installed on another transfer pipe that is branched from a transfer pipe on which the second recuperator is installed.

Thermal capacity required in the third recuperator may be larger than thermal capacity required in the first and second recuperators.

The constrained heat exchangers may include a first constrained heat exchanger, a second constrained heat exchanger, a third constrained heat exchanger, and a fourth constrained heat exchanger; the first constrained heat exchanger heating the working fluid passing through the first recuperator, the second constrained heat exchanger heating the working fluid passing through the second recuperator, and the third and fourth constrained heat exchangers heating the working fluid passing through the third recuperator.

The working fluid passing through the first to fourth constrained heat exchangers may be introduced into the low pressure turbine and the high pressure turbine, and the working fluid passing through the first to third recuperators may be introduced into a cooler to be cooled.

In accordance with another aspect of the present invention, a supercritical $CO_2$ generation system applying plural heat sources includes: a pump circulating a working fluid; a plurality of heat exchangers heating the working fluid through external heat sources; a plurality of turbines operated by the working fluid heated by passing through the heat exchangers; and a plurality of recuperators into which the working fluid passing through the turbines is introduced, respectively, and cooling the working fluid passing through the turbines by heat exchange between the working fluid passing through the turbines and the working fluid passing through the pump, in which the heat exchangers are heat sources using heat of waste heat gas exhausted from a waste heat source, and include a plurality of constrained heat exchangers having an emission regulation condition of a discharge end.

The emission regulation condition may be a temperature condition.

The number of recuperators may be the same as or less than the number of heat exchangers.

The turbines may include a low pressure turbine operating the pump and a high pressure turbine operating a generator.

The supercritical $CO_2$ generation system applying plural heat sources may further include a separate transfer pipe supplying the working fluid passing through the low pressure turbine and the high pressure turbine to the plurality of recuperators, respectively.

The recuperators may include a first recuperator, a second recuperator, and a third recuperator, and the constrained heat exchangers may include a first constrained heat exchanger, a second constrained heat exchanger, a third constrained heat exchanger, and a fourth constrained heat exchanger.

The first constrained heat exchanger may heat the working fluid passing through the first recuperator, the second constrained heat exchanger may heat the working fluid passing through the second recuperator, and the third and fourth constrained heat exchangers may heat the working fluid passing through the third recuperator.

When a temperature as the emission regulation condition of any one of the first to fourth constrained heat exchangers is higher than a temperature as the emission regulation condition of any other one of the first to fourth constrained heat exchangers, the transfer pipe transferring the working fluid ($mt_2$) passing through the high pressure turbine to one with the higher temperature of the emission regulation condition of the first constrained heat exchanger and the second constrained heat exchanger, may be connected.

The working fluid passing through the first to fourth constrained heat exchangers may be introduced into the low pressure turbine and the high pressure turbine.

The working fluid passing through the first to third recuperators may be introduced into a cooler to be cooled.

BRIEF DESCRIPTION OF THE DRAWINGS

The above and other features of the present invention will be more clearly understood from the following detailed description taken in conjunction with the accompanying drawings, in which.

DETAILED DESCRIPTION

Figure 1:
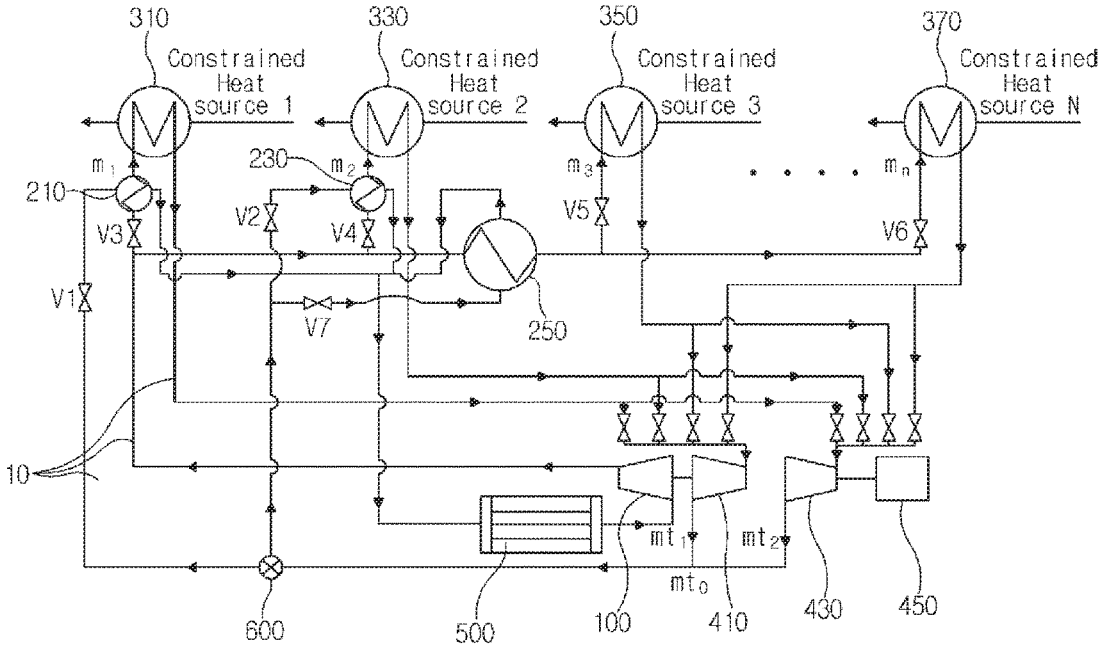
FIG. 1 is a diagram illustrating a supercritical $CO_2$ generation system according to an exemplary embodiment of the present invention.

Hereinafter, a supercritical $CO_2$ generation system applying plural heat sources according to an exemplary embodiment of the present invention will be described in detail with reference to the accompanying drawings.

Generally, the supercritical $CO_2$ generation system configures a closed cycle in which $CO_2$ used for power generation is not emitted to the outside, and uses supercritical $CO_2$ as a working fluid.

The supercritical $CO_2$ generation system uses supercritical $CO_2$ as a working fluid, thus may use exhaust gas discharged from a thermal power plant, etc. Therefore, the supercritical $CO_2$ generation system may not only be used as a single generation system, but also can be used for a hybrid generation system with a thermal generation system. The working fluid of the supercritical $CO_2$ generation system may be supplied by separating $CO_2$ from the exhaust gas, or separate $CO_2$ may also be supplied.

The supercritical $CO_2$ in the cycle (hereinafter, referred to as working fluid) passes through a compressor, and then is heated while passing through a heat source such as a heater, etc., to be a high-temperature high-pressure working fluid, thereby operating a turbine. A generator or a pump is connected to the turbine and power is generated by the turbine connected to the generator and the pump is operated by using the turbine connected to the pump. The working fluid passing through the turbine is cooled while passing through the heat exchanger, and the cooled working fluid is supplied to the compressor again to circulate in the cycle. The turbine or the heat exchanger may be provided in plural.

The present invention proposes a supercritical $CO_2$ generation system in which a plurality of heaters using waste heat gas are provided as heat sources and each heat exchanger is effectively disposed according to conditions such as an inlet and outlet temperature of the heat source, capacity, the number, etc., such that the same or smaller number of recuperators as compared to the number of heat sources are operated.

The supercritical $CO_2$ generation systems according to various exemplary embodiments of the present invention include a system in which all working fluid flowing in the cycle is supercritical, and a system in which most working fluid is supercritical and the rest of the working fluid is subcritical.

Further, in various exemplary embodiments of the present invention, $CO_2$ is used as a working fluid, and here, $CO_2$ includes carbon dioxide which is chemically pure, carbon dioxide including some impurities in general terms, and a fluid in which carbon dioxide is mixed with one or more fluids as additives.

It is to be noted, in the present invention, that terms "low temperature" and "high temperature" have relative meanings, thus should not be understood as being a temperature higher or lower than a specific reference temperature. Terms "low pressure" and "high pressure" also should be understood as having relative meanings.

FIG. 1 is a diagram illustrating a supercritical $CO_2$ generation system according to an exemplary embodiment of the present invention.

As illustrated in FIG. 1, the supercritical $CO_2$ generation system according to an exemplary embodiment of the present invention uses supercritical $CO_2$ as a working fluid, and includes a pump 100 circulating the working fluid, a plurality of recuperators and heat sources for heat exchanging with the working fluid passing through the pump 100, a plurality of turbines 410 and 430 operated by the working fluid heated while passing through the recuperators 210, 230, and 250 and heat sources 310, 330, 350, and 370, a generator 450 operated by the turbines 410 and 430, and a cooler 500 cooling the working fluid to be introduced into the pump 100.

The respective components of the present invention are connected by a transfer pipe 10 in which a working fluid flows, and it should be understood that the working fluid flows along the transfer pipe 10 even if not particularly mentioned. However, in a case in which a plurality of components are integrated, a part or a region that substantially functions as a transfer pipe 10 will be in the integrated component, thus even in this case, the working fluid should be understood as flowing along the transfer pipe 10. A flow path having a separate function will be additionally described.

The pump 100 is operated by a low pressure turbine 410 to be described below, and serves to transfer a low temperature working fluid that is cooled by passing through the cooler 500 to the recuperators 210, 230, and 250.

The recuperators 210, 230, and 250 may include a first recuperator 210, a second recuperator 230, and a third recuperator 250. The working fluid passing through the pump 100 may pass through the first recuperator 210 to be primarily heated and transferred to the heat source, or may pass through the second recuperator 230 to be primarily heated and transferred to the heat source. Alternatively, the working fluid may also pass through the third recuperator 250 to be primarily heated and transferred to the heat source.

The working fluid expanded by passing through the turbines 410 and 430 and cooled from high temperature to medium temperature may be introduced into any one of the first recuperator 210 to third recuperator 250. The cooled working fluid introduced into the recuperators 210, 230, and 250 may be heat exchanged with a working fluid passing through the pump 100 to primarily heat the working fluid passing through the pump 100. The working fluid cooled while heating the working fluid passing through the pump 100 is transferred to the cooler 500.

To this end, inlet ends of the recuperators 210, 230, and 250 through which the cooled working fluid passing through the turbines 410 and 430 may be provided with control valves V1, V2, and V7, respectively. The cooled working fluid is transferred to the cooler 500 to be secondarily cooled and transferred to the pump 100.

The working fluid transferred to the recuperators 210, 230, and 250 through the pump 100 is primarily heated by being heat exchanged with the working fluid passing through the turbines 410 and 430, and supplied to heat sources to be described below. To this end, the inlet ends through which the working fluid is introduced into of the first and second recuperators 210 and 230 from the pump 100 may be provided with control valves V3 and V4, respectively. Further, inlet ends of some heat sources 350 and 370 to be described below may also be provided with control valves V5 and V6, respectively.

In the present invention, the recuperators 210, 230, and 250 of which the number is the same as or less than that of heat sources may be provided, and in the present exemplary embodiment, a case in which the number of recuperators 210, 230, and 250 is three is described by way of example.

The first recuperator 210 is provided before an inlet end through which the working fluid is introduced into a first constrained heat exchanger 310 to be described below, and the second recuperator 230 may be provided before an inlet end through which the working fluid is introduced into a second constrained heat exchanger 330 to be described below. The third recuperator 250 may be provided before an inlet end through which the working fluid is introduced into third and fourth constrained heat exchangers 350 and 370 to be described below.

A flow rate $mt_0$ (hereinafter, defined as integrated flow rate) of the fluid that corresponds to sum of a flow rate $mt_2$ of the fluid passing through a high pressure turbine 430 and a flow rate $mt_1$ of the fluid passing through the low pressure turbine 410 is branched and introduced into the first to third recuperators 210 to 250. The control valve V1 is installed at the inlet end of the first recuperator 210, the second recuperator 230 is provided on other transfer pipe that is branched from a transfer pipe connected to the first recuperator 210, and the control valve V2 is installed at the inlet end of the second recuperator 230. The third recuperator 250 is installed on other transfer pipe that is branched from the transfer pipe on which the second recuperator 230 is installed, and the control valve V7 is installed at the inlet end of the third recuperator 250.

How much working fluid is branched from the integrated amount $mt_0$ of the working fluid and introduced into the first to third recuperators 210 to 250, respectively, is controlled by a separate controller (not illustrated), and a three-way valve 600 may be provided at a branch point (a point at which the transfer pipe 10 is branched to the first recuperator, and the second and third recuperators) for branch.

The heat source may be configured of plural constrained heat sources having a predetermined exhaust gas discharge condition. The above mentioned emission regulation condition is a temperature condition, and the emission regulation condition may be the same for all heat sources, or may be different for all heat sources.

Further, a flow rate of the working fluid introduced into the first constrained heat exchanger 310 is defined as $m_1$, a flow rate of the working fluid introduced into the second constrained heat exchanger 330 is defined as $m_2$, a flow rate of the working fluid introduced into the third constrained heat exchanger 350 is defined as $m_3$, and a flow rate of the working fluid introduced into an n-th constrained heat exchanger is defined as $m_n$.

In the present specification, a case in which first to fourth constrained heat exchangers 310, 330, 350, and 370 are provided will be described by way of example.

The first to fourth constrained heat exchangers 310, 330, 350, and 370 use gas having waste heat (hereinafter, referred to as waste heat gas) such as exhaust gas as a heat source having an emission regulation condition when discharging the waste heat gas.

The first constrained heat exchanger 310 heats the working fluid passing through the first recuperator 210 by heat of the waste heat gas. The waste heat gas losing heat in the first constrained heat exchanger 310 is cooled to a temperature that meets the emission regulation condition, and is discharged from the first constrained heat exchanger 310.

The second constrained heat exchanger 330 heats the working fluid passing through the second recuperator 230 by heat of the waste heat gas. The waste heat gas losing heat in the second constrained heat exchanger 330 is cooled to a temperature that meets the emission regulation condition, and is discharged from the second constrained heat exchanger 330.

The third constrained heat exchanger 350 heats the working fluid passing through the third recuperator 250 by heat of the waste heat gas. The waste heat gas losing heat in the third constrained heat exchanger 350 is cooled to a temperature that meets the emission regulation condition, and is discharged from the third constrained heat exchanger 350.

The fourth constrained heat exchanger 370 heats the working fluid passing through the third recuperator 250 by heat of the waste heat gas. The waste heat gas losing heat in the fourth constrained heat exchanger 370 is cooled to a temperature that meets the emission regulation condition, and is discharged from the fourth constrained heat exchanger 370.

Since both of the third constrained heat exchanger 350 and the fourth constrained heat exchanger 370 heat the working fluid passing through the third recuperator 250, the control valves V5 and V6 are provided at the inlet ends of the third constrained heat exchanger 350 and the fourth constrained heat exchanger 370, respectively, in order to distribute the working fluid to the third constrained heat exchanger 350 or the fourth constrained heat exchanger 370. The third recuperator 250 needs to serve to primarily heat the working fluid before supplying the working fluid to the plural heat sources, thus thermal capacity required in an inlet of the heat source is large. Accordingly, the third recuperator 250 has relatively larger thermal capacity as compared to the first and second recuperators 210 and 230, and it is preferred to be a type that may heat and transfer a relatively large amount of working fluid. As one having large thermal capacity is provided as the third recuperator 250, the working fluid may be transferred to the plural heat sources, thus the working fluid may be heated by the recuperators of which the number is the same as or smaller than that of the heat sources.

The working fluid heated while passing through the first to fourth constrained heat exchangers 310, 330, 350, and 370 is supplied to the low pressure turbine 410 and the high pressure turbine 430 to operate the turbines 410 and 430, and to this end, a control valve (not denoted by a reference numeral) is provided at front ends of the turbines 410 and 430.

The turbines 410 and 430 include the high pressure turbine 430 and the low pressure turbine 410, and are operated by the working fluid to operate the generator 450 connected to at least any one turbine of the turbines, thereby generating power. Since the working fluid is expanded while passing through the high pressure turbine 430 and the low pressure turbine 410, the turbines 410 and 430 also serve as an expander. In the present exemplary embodiment, the high pressure turbine 430 is connected to the generator 450 to generate power, and the low pressure turbine 410 serves to operate the pump 100.

Here, it is to be noted that terms "high pressure" and "low pressure" have relative meanings, thus should not be understood as being a pressure higher or lower than a specific reference pressure.

When a discharge control temperature condition of at least one of the first to fourth constrained heat exchangers 310, 330, 350, and 370 is low or a flow rate of the introduced waste heat gas is large, the required thermal capacity is also large.

Here, in a case in which thermal capacity required in the third recuperator 250 at the inlet end of the cooled fluid introduced into the third and fourth constrained heat exchangers 350 and 370 is large, the thermal capacity of the third and fourth constrained heat exchangers 350 and 370 is large. In this case, thermal energy of the integrated flow rate $mt_0$ may be maximally used, and flow rates $m_3$ and $m_4$ of the working fluids introduced into the third and fourth constrained heat exchangers 350 and 370 of the integrated flow rate $mt_0$ may be sufficiently heated in the third recuperator 250.

As such, in a case in which the thermal capacity required in the third and fourth constrained heat exchangers 350 and 370 is large, and emission regulation conditions of the third and fourth constrained heat exchangers 350 and 370 are similar to each other, a small number of large-capacity recuperators (third recuperator) may be used. The number of recuperators may be equal to or less than that of the third and fourth constrained heat exchangers 350 and 370. At this point, the integrated flow rate $mt_0$ of the working fluid may be transferred to the third recuperator 250 to heat the working fluid while satisfying the emission regulation condition of the waste heat gas. Alternatively, when the number of recuperators is the same as the number of third and fourth constrained heat exchangers 350 and 370, the integrated flow rate $mt_0$ of the working fluid may be uniformly distributed to the plurality of recuperators such that the working fluid may be heated while satisfying the emission regulation condition of the waste heat gas.

Further, in a case in which the thermal capacity required in the first and second constrained heat exchangers 310 and 330 is large, and emission regulation conditions of the first and second constrained heat exchangers 310 and 330 are different from each other, a plurality of small-capacity recuperators may be used. The number of recuperators may be equal to that of the first and second constrained heat exchangers 310 and 330 (first and second recuperators). At this point, the integrated flow rate $mt_0$ of the working fluid may be appropriately divided according to the emission regulation conditions of the first and second constrained heat exchangers 310 and 330 and transferred to the first and second recuperators 210 and 230 to heat the working fluid while satisfying the emission regulation condition of the waste heat gas.

In the supercritical $CO_2$ generation system according to the exemplary embodiment of the present invention having the above described configuration, a flow of the working fluid will be described by way of specific example as follows.

Some of the working fluid cooled by passing through the cooler 500 is circulated by the pump 100 and branched and transferred to the first and second recuperators 210 and 230 through the control valves V3 and V4, respectively. The flow rate $m_1$ of the working fluid transferred to the first recuperator 210 and the flow rate $m_2$ of the working fluid transferred to the second recuperator 230 may be different from each other according to the emission regulation conditions of the first and second constrained heat exchangers 310 and 330.

The working fluid branched to the first recuperator 210 and the second recuperator 230, respectively, is heat exchanged with the working fluid branched from the integrated flow rate $mt_0$ of the working fluid passing through the low pressure turbine 410 and the high pressure turbine 430 and passing through the first recuperator 210 and the second recuperator 230, respectively, to be primarily heated.

Then, the working fluid passing through the first recuperator 210 and the second recuperator 230, respectively, is transferred to the first constrained heat exchanger 310 and the second constrained heat exchanger 330, respectively, to be secondarily heated. At this point, the waste heat gas emission regulation conditions of the first and second constrained heat exchangers 310 and 330 may be similar to each other (about 200° C.), and the integrated flow rate $mt_0$ of the working fluid may be uniformly divided and transferred to the first and second constrained heat exchangers 310 and 330. Further, the waste heat gas introduced into the first and second constrained heat exchangers 310 and 330 may be medium temperature waste heat gas of which the temperature is relatively lower than that of the waste heat gas introduced into the third and fourth constrained heat exchangers 350 and 370 (due to relative distance from waste heat gas introduction portion). When the waste heat gas emission regulation conditions of the first and second constrained heat exchangers 310 and 330 are different from each other, the integrated amount $mt_0$ of the working fluid may be differently distributed according thereto.

The high temperature working fluid $m_1$ passing through the first constrained heat exchanger 310 is transferred to the low pressure turbine 410 or the high pressure turbine 430 to operate the low pressure turbine 410 or the high pressure turbine 430. The high temperature working fluid $m_2$ passing through the second constrained heat exchanger 330 is also transferred to the low pressure turbine 410 or the high pressure turbine 430 to operate the low pressure turbine 410 or the high pressure turbine 430. The turbine 410 or 430 that will be operated by the high temperature working fluid or whether or not both of the turbines 410 and 430 are operated by the high temperature working fluid is determined by the above mentioned controller according to an operation condition.

Alternatively, the working fluid may be directly transferred to the third recuperator 250 through the pump 100 without passing through the first and second recuperators 210 and 230. The third and fourth constrained heat exchangers 350 and 370 may be heat sources having waste heat gas emission regulation conditions that are the same as or different from that of the first and second constrained heat exchangers 310 and 330. Further, the third and fourth constrained heat exchangers 350 and 370 may be heat sources using high temperature waste heat gas of which the temperature is relatively higher than that of the waste heat gas introduced into the first and second constrained heat exchangers 310 and 330 (alternatively, the system may also be designed reversely). The low temperature working fluid is transferred to the third recuperator 250 to be primarily heated, branched to the third and fourth constrained heat exchangers 350 and 370 and heated, respectively, and then transferred to the low pressure turbine 410 or the high pressure turbine 430 to operate the low pressure turbine 410 or the high pressure turbine 430. The turbine 410 or 430 that will be operated by the high temperature working fluid or whether or not both of the turbines 410 and 430 are operated by the high temperature working fluid is determined by the above mentioned controller according to an operation condition.

As described above, the medium temperature working fluid that is heated by passing through the first to fourth constrained heat exchangers 310, 330, 350, and 370 and expanded while passing through the low pressure turbine 410 and the high pressure turbine 430 is branched and supplied to the first recuperator 210, the second recuperator 230, and the third recuperator 250, cooled by being heat exchanged with the low temperature working fluid passing through the pump 100, and introduced into the cooler 500.

Here, it is to be noted that terms "low temperature", "medium temperature", and "high temperature" have relative meanings, thus should not be understood as being a temperature higher or lower than a specific reference temperature.

Generally, an output of the high pressure turbine 430 operating the generator 450 needs to be larger than that of the low pressure turbine 410 operating the pump 100, thus it is preferable that working fluid in a medium temperature state by passing through the first and second constrained heat exchangers 310 and 330 is transferred to the low pressure turbine 410. Accordingly, it is preferable that the working fluid passing through the third and fourth constrained heat exchangers 350 and 370 in a relatively higher temperature state as compared to the first and second constrained heat exchangers 310 and 330 is transferred to the high pressure turbine 430.

However, to which turbine 410 or 430 the medium temperature working fluid or the high temperature working fluid is transferred may be determined according to the operation condition or the emission regulation condition of the waste heat gas.

Hereinabove, an exemplary embodiment in which the integrated flow rate of the working fluid passing through the low pressure turbine and the high pressure turbine is branched and transferred to the first and second recuperators has been described, but each flow rate of the low pressure turbine and the high pressure turbine may also be transferred to the first and second recuperators (the same configuration as the above described exemplary embodiment will be described using the same reference numerals, and detailed description thereof will be omitted).

Figure 2:
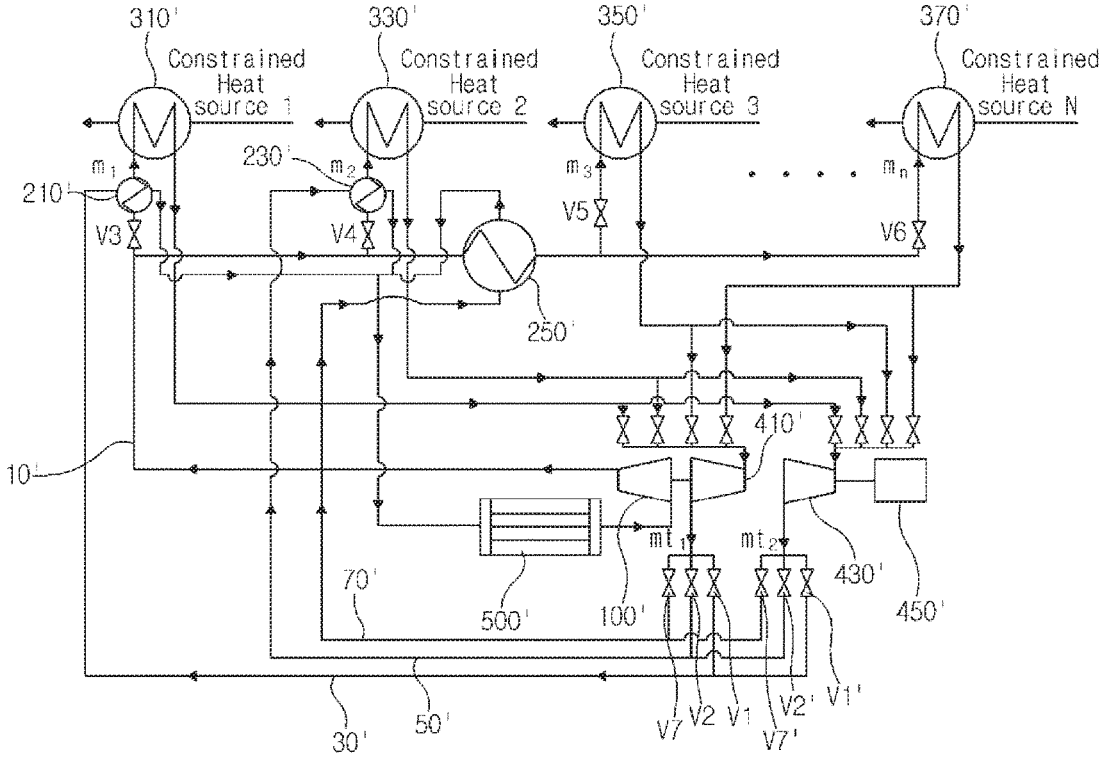
FIG. 2 is a diagram illustrating a supercritical $CO_2$ generation system according to another exemplary embodiment of the present invention.

FIG. 2 is a diagram illustrating a supercritical $CO_2$ generation system according to another exemplary embodiment of the present invention.

As illustrated in FIG. 2, in the supercritical $CO_2$ generation system according to another exemplary embodiment of the present invention, a working fluid $mt_1$ passing through a low pressure turbine 410' and a working fluid $mt_2$ passing through a high pressure turbine 430' may be transferred to first to third recuperators 210', 230', and 250', respectively. At this point, control valves are provided at an output end of the low pressure turbine 410' and an output end of the high pressure turbine 430', respectively, and a transfer pipe connecting between the output end of the low pressure turbine 410' and a rear end of the control valve is connected to transfer pipes each connected to the first to third recuperators 210' to 250'.

That is, a valve V1 is installed at the output end of the low pressure turbine 410', a control valve V1' is installed at the output end of the high pressure turbine 430', and a transfer pipe 30' connects between the control valve V1' of the high pressure turbine 430' side and the first recuperator 210' to each other. The rear end of the control valve V1' is connected to the transfer pipe 30'. A valve V2 is installed at the output end of the low pressure turbine 410', a control valve V2' is installed at the output end of the high pressure turbine 430', and a transfer pipe 50' connects between the control valve V2' of the high pressure turbine 430' side and the second recuperator 230' to each other. A rear end of the control valve V2' is connected to the transfer pipe 50'. A valve V7 is installed at the output end of the low pressure turbine 410', a control valve V7' is installed at the output end of the high pressure turbine 430', and a transfer pipe 70' connects between the control valve V7' of the high pressure turbine 430' side and the third recuperator 250' to each other. A rear end of the control valve V7' is connected to the transfer pipe 70'.

Unlike the above described exemplary embodiment, since each of the output ends of the low pressure turbine 410' and the high pressure turbine 430' controls a flow rate of the working fluid, and the respective amount of the working fluid of the low pressure turbine 410' and the high pressure turbine 430' or an integrated flow rate thereof is transferred to the first to third recuperators 210', 230', and 250', respectively, an emission regulation condition of heat sources may be satisfied by using a branched amount of the integrated flow rate and a temperature of the working fluid.

For example, a case in which an emission regulation condition of a first constrained heat exchangers 310' is 220° C., an emission regulation condition of a second constrained heat exchangers 330' is 200° C., and emission regulation conditions of a third and fourth constrained heat exchangers 350' and 370' are 200° C. may be assumed. In this case, the emission regulation condition may be satisfied through the branched amount of the integrated flow rate $mt_0$ as in the above described exemplary embodiment, and may also be satisfied by supplying working fluid at different temperatures as in the present exemplary embodiment.

That is, a larger flow rate of the working fluid discharged from the high pressure turbine 430' to which a relatively higher temperature working fluid as compared to the low pressure turbine 410' is supplied in order to operate a generator 450', than that of the working fluid of the low pressure turbine 410' is supplied to the first constrained heat exchanger 310' through the transfer pipe 30', thereby controlling the heat exchange with the waste heat gas to be less performed as compared to that in the second constrained heat exchanger 330'. Further, a larger flow rate of the working fluid discharged from the low pressure turbine 410' to which a relatively lower temperature working fluid as compared to the high pressure turbine 430' is supplied, than that of the working fluid of the high pressure turbine 430' is supplied to the second to fourth constrained heat exchangers 330', 350', and 370' through the transfer pipes 50' and 70', thereby controlling the heat exchange with the waste heat gas to be less performed as compared to that in the first constrained heat exchanger 310'.

Alternatively, the emission regulation condition of the heat sources may also be satisfied by a method in which only the working fluid of the high pressure turbine 430' is transferred to the first constrained heat exchanger 310', and only the working fluid of the low pressure turbine 410' is transferred to the second to fourth constrained heat exchangers 330', 350', and 370'.

According to such principle, the working fluid may be heated and supplied to the turbines 410 and 430 while satisfying the respective waste heat gas emission regulation condition of the first to fourth constrained heat exchangers 310' to 370'.

In the supercritical $CO_2$ generation system applying plural heat sources according to an exemplary embodiment of the present invention, each heat exchanger is effectively disposed according to conditions such as an inlet and outlet temperature, capacity, the number, etc. of the heat source, such that it is possible to use the same or smaller number of recuperators as compared to the number of heat sources, thereby simplifying the system configuration and implementing effective operation.

The exemplary embodiments of the present invention described above and illustrated in the drawings should not be interpreted as limiting the technical idea of the present invention. The scope of the present invention is limited only by the accompanying claims, and those skilled in the art may modify and change the technical idea of the present invention in various forms. Therefore, it is obvious to those skilled in the art that these alterations and modifications fall within the scope of the present invention.

What is claimed is:

1. A supercritical CO2 generation system applying plural heat sources, comprising:

a pump circulating a working fluid;

a plurality of heat exchangers heating the working fluid through external heat sources;

a plurality of turbines operated by the working fluid heated by passing through the heat exchangers;

a plurality of recuperators cooling the working fluid passing through the turbines by heat exchange between the working fluid passing through the turbines and the working fluid passing through the pump, and a plurality of control valves disposed between the plurality of turbines and the plurality of recuperators, wherein the working fluid passing through the pump is introduced to the plurality of heat exchangers through the plurality of recuperators, wherein the heat exchangers are heat sources using heat of waste heat gas and include a plurality of constrained heat exchangers having an emission regulation condition of a discharge end, and wherein the working fluid passing through the turbines is integrated to have an integrated flow rate (mt0) before being supplied to the plurality of control valves.

2. The supercritical CO2 generation system applying plural heat sources of claim 1, wherein the emission regulation condition is a temperature condition.

3. The supercritical CO2 generation system applying plural heat sources of claim 2, wherein the number of recuperators is the same as or less than the number of heat exchangers.

4. The supercritical CO2 generation system applying plural heat sources of claim 3, wherein the turbines include a low pressure turbine operating the pump and a high pressure turbine operating a generator, and the integrated flow rate (mt0) of the working fluid passing through the low pressure turbine and the high pressure turbine is branched and supplied to the plurality of recuperators.

5. The supercritical CO2 generation system applying plural heat sources of claim 4, further comprising a three-way valve installed at a branch point of a transfer pipe through which the working fluid is transferred, so that the working fluid is branched.

6. The supercritical CO2 generation system applying plural heat sources of claim 5, wherein the recuperators include a first recuperator, a second recuperator, and a third recuperator, some of the integrated flow rate (mt0) of the working fluid is branched to the first recuperator, and the rest of the integrated flow rate (mt0) of the working fluid is branched to the second and third recuperators.

7. The supercritical CO2 generation system applying plural heat sources of claim 6, wherein the third recuperator is installed on another transfer pipe that is branched from a transfer pipe on which the second recuperator is installed.

8. The supercritical CO2 generation system applying plural heat sources of claim 7, wherein thermal capacity of the third recuperator is larger than thermal capacity of the first and second recuperators.

9. The supercritical CO2 generation system applying plural heat sources of claim 8, wherein the constrained heat exchangers include a first constrained heat exchanger, a second constrained heat exchanger, a third constrained heat exchanger, and a fourth constrained heat exchanger; the first constrained heat exchanger heating the working fluid passing through the first recuperator, the second constrained heat exchanger heating the working fluid passing through the second recuperator, and the third and fourth constrained heat exchangers heating the working fluid passing through the third recuperator.

10. The supercritical CO2 generation system applying plural heat sources of claim 9, wherein the working fluid passing through the first to fourth constrained heat exchangers is introduced into the low pressure turbine and the high pressure turbine, and the working fluid passing through the first to third recuperator is introduced into a cooler to be cooled.

11. A supercritical CO2 generation system applying plural heat sources, comprising:

a pump circulating a working fluid;

a plurality of heat exchangers heating the working fluid through external heat sources;

a plurality of turbines operated by the working fluid heated by passing through the heat exchangers; and a plurality of recuperators into which the working fluid passing through the turbines is introduced, respectively, and cooling the working fluid passing through the turbines by heat exchange between the working fluid passing through the turbines and the working fluid passing through the pump, wherein the heat exchangers are heat sources using heat of waste heat gas and include a plurality of constrained heat exchangers having an emission regulation condition of a discharge end, and wherein the working fluid passing through the pump is introduced to the plurality of heat exchangers through the plurality of recuperators.

12. The supercritical CO2 generation system applying plural heat sources of claim 11, wherein the emission regulation condition is a temperature condition.

13. The supercritical CO2 generation system applying plural heat sources of claim 11, wherein the number of recuperators is the same as or less than the number of heat exchangers.

14. The supercritical CO2 generation system applying plural heat sources of claim 13, wherein the turbines include a low pressure turbine operating the pump and a high pressure turbine operating a generator.

15. The supercritical CO2 generation system applying plural heat sources of claim 14, further comprising a separate transfer pipe supplying the working fluid passing through the low pressure turbine and the high pressure turbine to the plurality of recuperators, respectively.

16. The supercritical CO2 generation system applying plural heat sources of claim 15, wherein the recuperators include a first recuperator, a second recuperator, and a third recuperator; and the constrained heat exchangers include a first constrained heat exchanger, a second constrained heat exchanger, a third constrained heat exchanger, and a fourth constrained heat exchanger.

17. The supercritical CO2 generation system applying plural heat sources of claim 16, wherein the first constrained heat exchanger heats the working fluid passing through the first recuperator, the second constrained heat exchanger heats the working fluid passing through the second recuperator, and the third and fourth constrained heat exchangers heat the working fluid passing through the third recuperator.

18. The supercritical CO2 generation system applying plural heat sources of claim 17, wherein when a temperature as the emission regulation condition of any one of the first to fourth constrained heat exchangers is higher than a temperature as the emission regulation condition of any other one of the first to fourth constrained heat exchangers, the transfer pipe transferring the working fluid (mt2) passing through the high pressure turbine to one with the higher temperature of the emission regulation condition of the first constrained heat exchanger and the second constrained heat exchanger, is connected.

19. The supercritical CO2 generation system applying plural heat sources of claim 18, wherein the working fluid passing through the first to fourth constrained heat exchangers is introduced into the low pressure turbine and the high pressure turbine.

20. The supercritical CO2 generation system applying plural heat sources of claim 19, wherein the working fluid passing through the first to third recuperators is introduced into a cooler to be cooled.

* * * * *